US005823863A

United States Patent [19]

Henneborn et al.

[11] Patent Number: 5,823,863

[45] Date of Patent: Oct. 20, 1998

[54] MACHINE FOR POLISHING AND/OR GRINDING

[75] Inventors: Roland Henneborn; Peter Holz, both of Cologne; Michael Lechner, Linnich; Wolfgang Volker, Toenisvorst, all of Germany

[73] Assignee: Messer Griesheim GmbH, Germany

[21] Appl. No.: 806,388

[22] Filed: Feb. 28, 1997

[30] Foreign Application Priority Data

Jul. 3, 1996 [DE] Germany ..... 196 08 935.2
Oct. 2, 1996 [DE] Germany ..... 197 04 860.9

[51] Int. Cl.[6] ..... B24B 55/02

[52] U.S. Cl. ..... 451/449; 451/450; 451/488

[58] Field of Search ..... 459/449, 450, 459/488

[56] References Cited

U.S. PATENT DOCUMENTS

| | | | |
|---|---|---|---|
| 1,952,910 | 3/1934 | Decker . | |
| 2,635,399 | 4/1953 | West . | |
| 4,129,966 | 12/1978 | Smart . | |
| 4,523,411 | 6/1985 | Freerks | 451/486 |
| 4,765,096 | 8/1988 | Lang | 451/449 |
| 5,088,242 | 2/1992 | Lubbering et al. | 451/449 |

FOREIGN PATENT DOCUMENTS

| | | | |
|---|---|---|---|
| 3910590 | 4/1990 | Germany . | |
| 4222766A1 | 1/1994 | Germany . | |
| 2230213 | 10/1990 | Japan | 451/449 |
| 1550430 | 8/1979 | United Kingdom | 451/449 |

*Primary Examiner*—Robert A. Rose
*Assistant Examiner*—George Nguyen
*Attorney, Agent, or Firm*—Connolly & Hutz

[57] ABSTRACT

The prior art discloses machines which, for cooling the surface to be machined, have a gas supply line which opens into a gas outlet which is in the direct vicinity of the polishing disk. When $CO_2$ is used as cooling gas, stoppages, which can be traced back to snow formation of the $CO_2$, may occur in the line and in the gas outlet. In order to avoid blockages, the machine is assigned means for the supply of the liquid or supercritical $CO_2$ which comprise a valve for regulating the throughflow quantity of the $CO_2$ with an expansion nozzle, the valve being arranged inside the machine.

20 Claims, 2 Drawing Sheets

MACHINE FOR POLISHING AND/OR GRINDING

BACKGROUND OF THE INVENTION

DE-C 39 10 590 discloses a machine from the applicant which comprises a polishing disk and a cold gas supply for cooling the surface to be polished or to be ground, the cold gas supply preferably opening into a gas outlet which is arranged in the axis of rotation of the polishing disk. The appliance is preferably operated using $N_2$ as cold gas, which is stored in liquid form, evaporated and fed to the gas outlet via the cold gas supply. In order to ensure an optimum operating temperature of the cold gas, which temperature essentially depends on the material properties of the surface to be treated, the nitrogen has to be temperature-controlled in a complicated manner. It is also known to operate such a machine using $CO_2$ as cold gas, which in the case of the evaporation of liquid $CO_2$ has a temperature of −78° C. This temperature is advantageous for the operation of such machines, since it generally satisfies the requirements for the cold needed. However, the machine employed according to the prior art is preferably operated with $N_2$, since this gas can be fed in lines without problems. For this purpose, it is accepted that, the evaporated nitrogen is brought to the desired temperature by means of the supply of energy. Although $CO_2$ comes substantially closer to the actual requirements of the operating temperature, and the production of the raw material liquid $CO_2$ consumes substantially less energy, $N_2$ has been preferred until now, since $CO_2$ has the property of forming $CO_2$ snow during its phase transition from liquid to gas, said snow blocking the lines and the gas outlet. The operation of the machine is considerably hampered thereby and the operating duration is restricted.

SUMMARY OF THE INVENTION

The invention is therefore based on the object of providing a machine for polishing and grinding with which treatment of surfaces with $CO_2$ as cold gas is possible in a fault free manner.

Using the machine, it is now possible to polish and/or to grind highly sensitive materials such as paint surfaces or plastics, using $CO_2$ cooling, without blockages of the gas supply or of the gas outlet with $CO_2$ snow leading to disturbances in the working process or to a premature termination of the treatment.

BRIEF DESCRIPTION OF THE DRAWINGS

The drawings show the machine according to the invention in schematic form.

DETAILED DESCRIPTIONS

Figure 1:
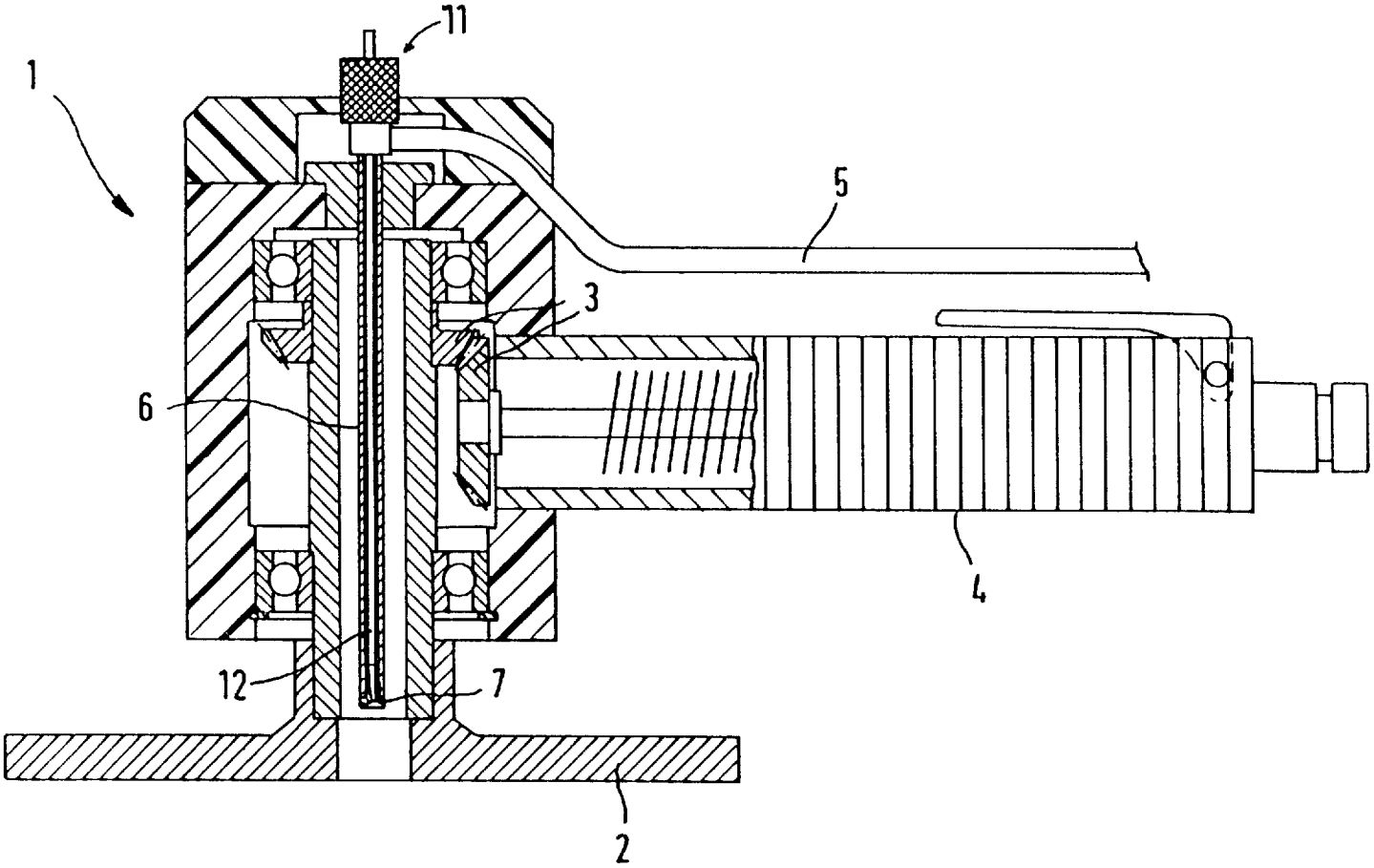
FIG. 1 shows a machine suitable for carrying out the method.

In the machine 1 shown in FIG. 1, a polishing disk 2 as machining tool is set rotating by means of a gearbox 3 which is driven by a compressed air motor 4. Into the axis of rotation there leads a gas supply 5, which opens into a valve which essentially comprises an adjusting device 11, a pipe 6, valve spindle 12 arranged inside the pipe 6 and an expansion nozzle 7.

Figure 2:
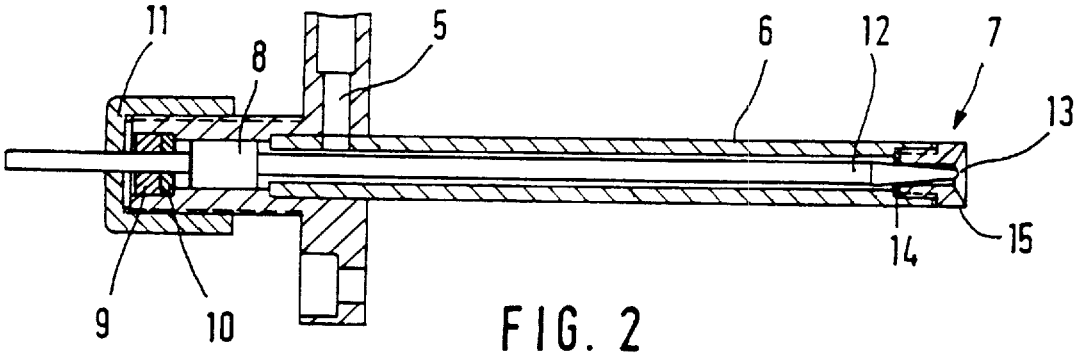
FIG. 2 shows an extract from the machine in FIG. 1 in which the gas supply and the gas outlet are shown.

The gas supply 5 and the valve are shown more closely in FIG. 2. The gas supply 5 opens into the pipe 6, whose upper end is closed via a compression washer 9 and a stuffing box 10 with the aid of the adjusting device 11, which is designed as a union nut, using which the valve spindle 12 can be moved axially inside the pipe 6 by means of the thread 8. The expansion nozzle 7 has an opening 13 tapering conically at the outlet, an orifice plate 14 and a compression screw 15.

Figure 3:
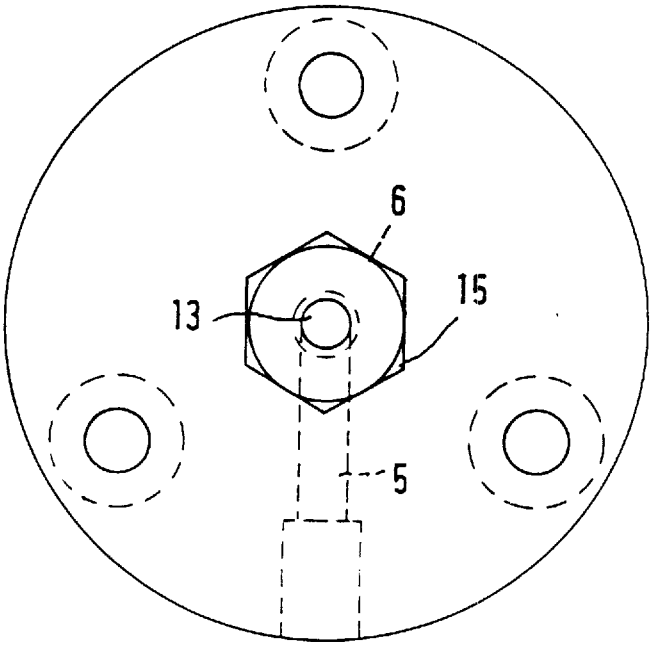
FIG. 3 shows a cross section through the gas outlet.

Shown in FIG. 3 are the opening 13, tapering conically at the outlet, the orifice plate 14, the compression screw 15, the pipe 6 and the gas supply 5.

During operation, the liquid or supercritical $CO_2$ flows via the gas supply 5 into the machine 1 from a rising-tube flask, a high pressure, medium pressure, low pressure tank or a pipeline. In the process, it passes through the valve, which regulates the throughflow quantity of liquid or supercritical $CO_2$. The liquid or supercritical $CO_2$ passes into the pipe 6 and emerges via the expansion nozzle 7. As a result of the abrupt expansion, the liquid or supercritical $CO_2$ evaporates and changes into the gas phase. At this point it has a temperature of −78° C., which is very well suited for the cooling of sensitive surfaces. In this arrangement it is characteristic that no impermissible pressure losses occur in the gas supply 5 and the pipe 6. As a result, the disturbing formation of $CO_2$ snow in these lines cannot occur, said snow formation blocking the supply of $CO_2$ and causing a blockage of the gas paths. The expansion takes place only in the area of the nozzle.

The expansion nozzle 7 is arranged directly in the vicinity of the working area of the machining tool. It is preferably in the axis of rotation of the polishing disk 2. However, arrangements are also conceivable in which the expansion nozzle 7 is fitted in the area of the polishing disk 2 in such a way that it carries out a rotational movement with the polishing disk 2. It is of course also possible for a plurality of expansion nozzles 7 to be fitted. Control cones or exchangeable openings tapering conically at the outlet are considered for the opening of the expansion nozzle 7. Perforated diaphragms can also be used. In the case where a control cone is used, the gas throughput can be adapted to the polishing or grinding task to be accomplished at that time.

According to the invention, what is important in any case is that the diameter of the valve spindle 12 and the clear width of the pipe 6 are dimensioned such that the liquid or supercritical $CO_2$ does not expand in the interior of the pipe 6. The dimensions of the valve spindle 12 and of the pipe 6 are preferably selected such that the annular gap between the inner surface of the pipe 6 and the outer surface of the valve spindle 12 is about 0.2 to 2 mm. In this case, a pressure drop can occur only at the emergence of the still liquid or supercritical $CO_2$ from the pipe 6, and the flow paths of the liquid or supercritical $CO_2$ are thus reliably kept free.

By means of the use of $CO_2$, it is also possible in the configuration of the gas supply 5 to do without highly-insulated materials, such as are used when liquid nitrogen is employed. For liquid or supercritical $CO_2$, flexible plastic lines can be used, which enable easier handling and greater mobility of the machine 1. Complicated thermal insulation is not necessary.

For the machining of surfaces which place special requirements on the machining temperature, it is possible to equip the expansion nozzle 7 with a temperature sensor which measures the temperature currently present and controls a heating device, preferably a small heating coil, which is arranged in the area of the expansion nozzle 7. By this means, temperature control of the environment of the expansion nozzle 7 can be carried out. However, such an embodiment would represent a variant for special cases, since the advantage of the use, now improved, of $CO_2$ is precisely that it is possible, in terms of apparatus, to work using $CO_2$, which makes temperature regulation largely superfluous, since the freshly evaporated $CO_2$ has a temperature which, according to experience, leads to particularly ideal operating conditions.

What is claimed is:

1. A machine for selectively polishing and grinding with a machining tool executing a relative movement with respect to the workpiece, the machining tool having means for the supply of liquid or supercritical CO2, wherein the means for the supply of the liquid or supercritical CO2 comprising a valve for regulating the throughflow quantity of the CO2 with an expansion nozzle for the liquid or supercritical CO2, the valve being arranged inside the machine, the valve having a pipe having an inner surface through which there runs a valve spindle having an outer surface with an annular gap between the inner surface of the pipe and the outer surface, and the annular gap between the inner surface of the pipe and the outer surface of the valve spindle is 0.2 to 2 mm.

2. The machine as claimed in claim 1, wherein the valve spindle has a diameter dimensioned to be less than the clear width of the pipe, an orifice plate being provided to said valve spindle, the expansion nozzle which is to be opened and may be closed by means of the valve spindle being conically tapered and having an opening broadening at the outlet, and the diameter of the valve spindle and the clear width of the pipe are dimensioned such that the liquid or supercritical CO2 does not expand in the interior of the pipe.

3. The machine as claimed in claim 2, wherein the expansion nozzle is arranged directly in the vicinity of the working face of the machining tool.

4. The machine as claimed in claim 3, wherein the means for the supply of the liquid or supercritical CO2 are arranged coaxially inside a hollow spindle carrying the machining tool.

5. The machine as claimed in claim 4, wherein a heating device whose heat dissipation is controlled by a temperature sensor is arranged in the region of the expansion nozzle.

6. The machine as claimed in claim 5, wherein the liquid or supercritical CO2 is supplied to the valve through a flexible plastic tube.

7. The machine as claimed in claim 4, wherein the annular gap between the inner surface of the pipe and the outer surface of the valve spindle is 0.2 to 2 mm.

8. The machine as claimed in claim 1, wherein the expansion nozzle is arranged directly in the vicinity of the working face of the machining tool.

9. The machine as claimed in claim 1, wherein a heating device whose heat dissipation is controlled by a temperature sensor is arranged in the region of the expansion nozzle.

10. The machine as claimed in claim 1, wherein the liquid or supercritical CO2 is supplied to the valve through a flexible plastic tube.

11. A machine for selectively polishing and grinding with a machining tool executing a relative movement with respect to the workpiece, the machining tool having means for the supply of liquid or supercritical CO2, wherein the means for the supply of the liquid or supercritical CO2 comprising a valve for regulating the throughflow quantity of the CO2 with an expansion nozzle for the liquid or supercritical CO2, the valve being arranged inside the machine, and the means for the supply of the liquid or supercritical CO2 are arranged coaxially inside a hollow spindle carrying the machining tool.

12. The machine as claimed in claim 4, wherein the valve has a pipe through which there runs a valve spindle whose diameter is dimensioned to be less than the clear width of the pipe, an orifice plate being provided to said valve spindle, the expansion nozzle which is to be opened and may be closed by means of the valve spindle being conically tapered and having an opening broadening at the outlet, and the diameter of the valve spindle and the clear width of the pipe are dimensioned such that the liquid or supercritical CO2 does not expand in the interior of the pipe.

13. The machine as claimed in claim 12, wherein the expansion nozzle is arranged directly in the vicinity of the working face of the machining tool.

14. The machine as claimed in claim 13, wherein a heating device whose heat dissipation is controlled by a temperature sensor is arranged in the region of the expansion nozzle.

15. The machine as claimed in claim 14, wherein the CO2 is supplied to the valve through a flexible plastic tube.

16. The machine as claimed in claim 15, wherein the annular gap between the inner surface of the pipe and the outer surface of the valve spindle is 0.2 to 2 mm.

17. The machine as claimed in claim 11, wherein the expansion nozzle is arranged directly in the vicinity of the working face of the machining tool.

18. The machine as claimed in claim 11, wherein a heating device whose heat dissipation is controlled by a temperature sensor is arranged in the region of the expansion nozzle.

19. The machine as claimed in claim 11, wherein the liquid or supercritical CO2 is supplied to the valve through a flexible plastic tube.

20. The machine as claimed in claim 11, the valve having a pipe having an inner surface through which there runs a valve spindle having an outer surface with an annular gap between the inner surface of the pipe and the outer surface, and wherein the annular gap between the inner surface of the pipe and the outer surface of the valve spindle is 0.2 to 2 mm.

* * * * *